US006394322B1

(12) United States Patent
Sekiya et al.

(10) Patent No.: US 6,394,322 B1
(45) Date of Patent: May 28, 2002

(54) WATER PITCHER

(75) Inventors: Makoto Sekiya, Tsubame (JP); Wen-Shung Lin, Taipei (TW)

(73) Assignee: Joyce Worldwide Ltd., Taipei (TW)

( * ) Notice: Subject to any disclaimer, the term of this patent is extended or adjusted under 35 U.S.C. 154(b) by 0 days.

(21) Appl. No.: 09/588,794

(22) Filed: Jun. 6, 2000

(30) Foreign Application Priority Data

Mar. 17, 2000 (JP) ..... 2000-001645

(51) Int. Cl.[7] ..... A47G 19/12
(52) U.S. Cl. ..... 222/465.1; 222/478; 222/572
(58) Field of Search ..... 222/465.1, 566, 222/570, 481, 478, 548, 572; 220/300, 324, 780, 784, 787, 789; D7/316, 317

(56) References Cited

U.S. PATENT DOCUMENTS 1,992,513 A * 2/1935 Solomon ..... 220/300
4,583,653 A * 4/1986 Minsky ..... 220/300
4,895,281 A * 1/1990 Lorenz ..... 222/465.1
5,072,850 A * 12/1991 Gagnon et al. ..... 220/300
5,158,216 A * 10/1992 Viani ..... 222/465.1
5,273,194 A * 12/1993 McNamara ..... 222/470
5,275,307 A * 1/1994 Freese ..... 222/42
D418,714 S * 1/2000 Fox et al. ..... D7/319

* cited by examiner

*Primary Examiner*—Joseph A. Kaufman
*Assistant Examiner*—Stephanie Willatt
(74) *Attorney, Agent, or Firm*—Thomas Schneck

(57) ABSTRACT

A water pitcher which is easily cleansed and kept clean is provided. The water pitcher for accommodating water and ice cubes includes a pitcher body having an upper portion providing a pouring lip, and a cover having a pouring cutout for pouring water and a window for refilling water and ice cubes. The pouring cutout of the cover is paired with the pouring lip of the pitcher body to form a restricted region for allowing water to flow therethrough and to prevent the ice cubes from leaving the water pitcher. The window for refilling water and ice cubes is located opposite to the pouring cutout. By providing protrusions to the interior of the pitcher body and respective holes and stoppers to the cover, the cover is thus stably mounted and easier removed from the pitcher body. Therefore, the cover can be removed away for cleansing. Furthermore, the cover can thus be prevented from dropping into the interior and can be safely rested at its predetermined position.

2 Claims, 2 Drawing Sheets

WATER PITCHER

BACKGROUND OF THE INVENTION (1) Field of the Invention

The invention relates to a water pitcher which is used to pour cold water into cups or glasses.

(2) Description of the Prior Art

Conventionally, a water pitcher includes a pitcher body having an upper opening and a pouring lip, and an integrated cover to seal the upper opening. The cover includes a pouring cutout for pouring water and a window for refilling water and ice cubes. The pouring cutout for pouring water is located with respect to the pouring lip and is included to form a restricted region connecting interior and exterior of the water pitcher for preventing the ice cubes from leaving the water pitcher therefrom. The window for refilling water and ice cubes is located opposite to the pouring cutout for allowing water and ice cubes (for example, those of 1–2 cm long in each dimension) to go therethrough. While pouring the water of the water pitcher into a cup or a glass via the pouring cutout of the cover and the pouring lip of the pitcher body, the ice cubes can be retained inside the water pitcher by the restricted region formed by the pouring cutout.

Nevertheless, the cover of the conventional water pitcher is usually welded onto the pitcher body, so that the removal of the cover from the pitch body is impossible. Thus, it is infeasible to cleanse the interior bottom of the pitcher body.

SUMMARY OF THE INVENTION

Accordingly, it is a primary object of the present invention to provide a water pitcher whose interior can be easily cleaned.

The water pitch of the present invention as stated in claim 1 includes a pitcher body for accommodating water and ice cubes and a removable cover. The pitcher body has an upper opening and a pouring lip. The cover resting upon the upper opening has a pouring cutout for pouring water and a window for refilling water and ice cubes. By mating the pitcher body and the cover, a restricted pouring region can be formed by the pouring lip of the pitcher body and the pouring cutout of the removable cover. The restricted pouring region can be used to connect the interior and the exterior of the water pitcher and is used to prevent the ice cubes from leaving the water pitcher while pouring the water. The window for refilling water and ice cubes is located opposite to the pouring cutout. The water pitcher of the present invention is characterized in that the cover is removable from the upper opening of the pitcher body.

By contacting the interior stopper of the pitcher body with the respective stopper of the cover, the opening potion of the cover can align with the pouring lip of the pitcher body.

All these objects are achieved by the water pitcher described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a water pitcher. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
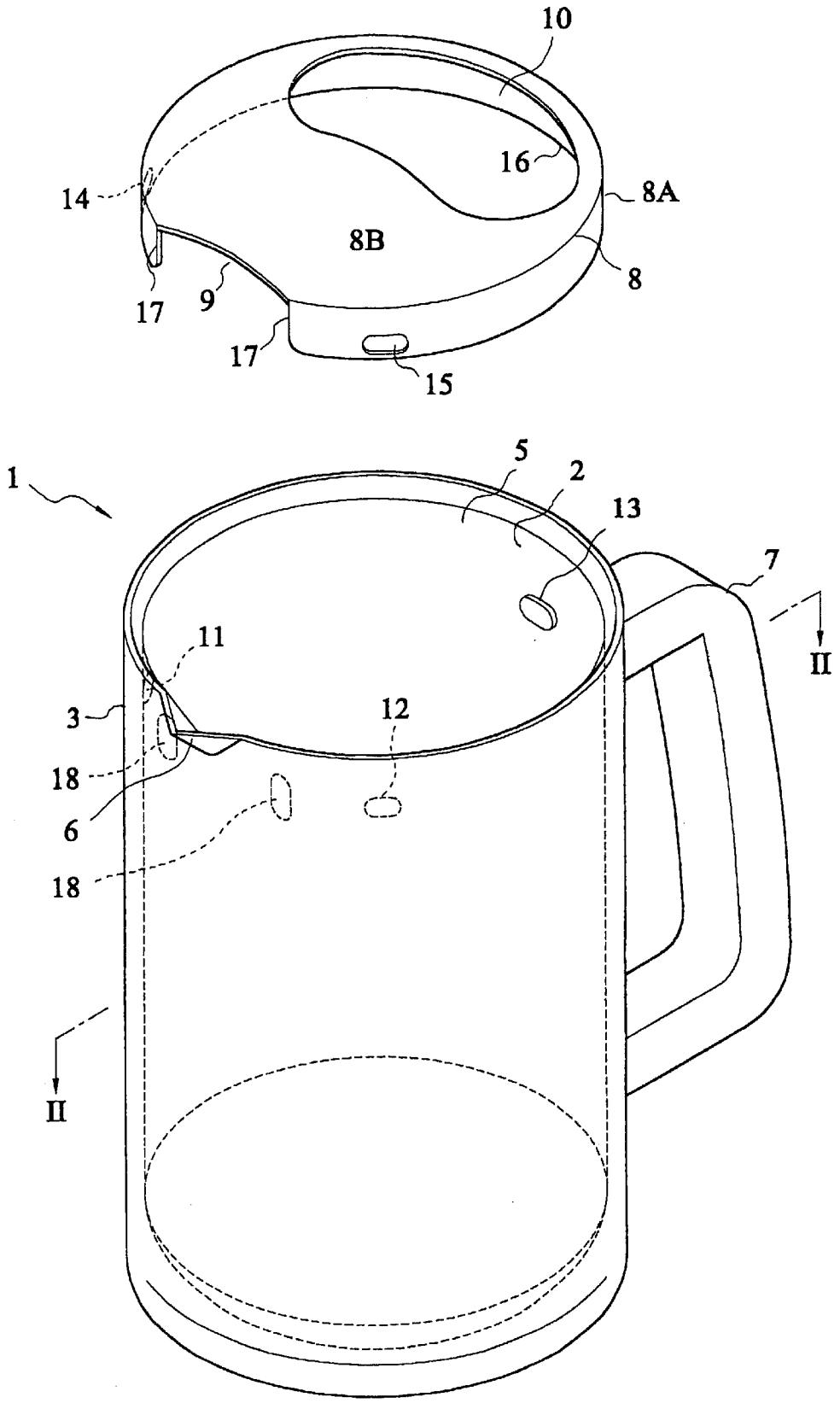
FIG. 1 is an exploded perspective view of a preferred embodiment of the water pitcher in accordance with the present invention.
Figure 2:
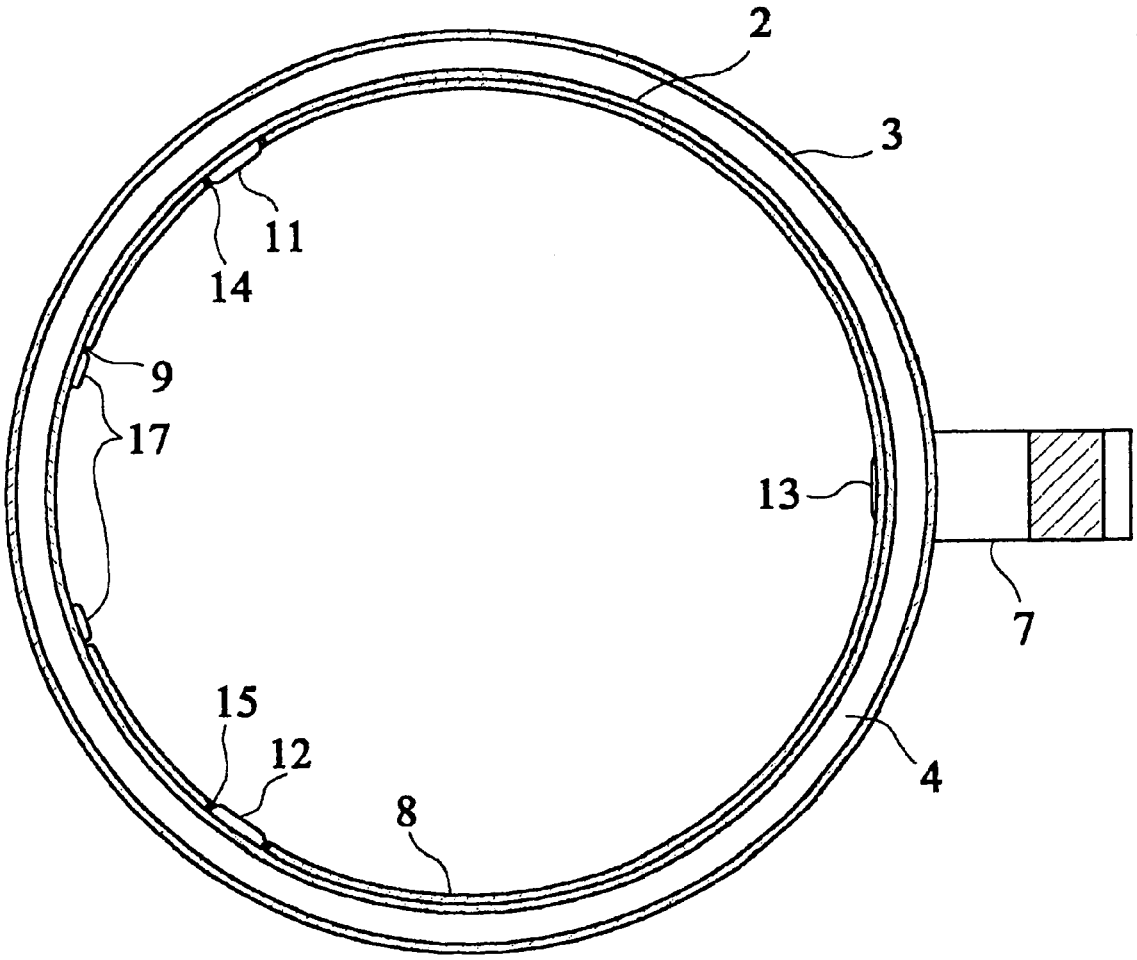
FIG. 2 is a cross sectional view taken along line II—II of FIG. 1.

Please refer to FIG. 1 and FIG. 2 for an exploded perspective view and a cross sectional view of a preferred embodiment of the water pitcher in accordance with the present invention. The water pitcher for accommodating water and ice cubes includes a pitcher body 1 and a cover 8. The pitcher body 1, shaped as a cylindrical hollow dual-pipe structure having a sealed end, includes an interior pipe 2 and an exterior jacket 3, in which a vacuum heat-insulation annular spacing 4 is formed between the interior pipe 2 and the exterior jacket 3. As shown in FIG. 1, an upper opening 5 of the pitcher body 1 is formed by sealing the vacuum heat-insulation annular spacing 4 at one end away from the sealed end of the pitcher body 1. The pitcher body 1 further includes a pouring lip 6 formed at one side of the upper opening 5 and a handle 7 at the external side of the exterior jacket 3.

The cover 8 removable from the upper opening 5 includes a pouring cutout 9 located at one side of a perimeter 8A thereof, for pouring water. The pouring cutout 9 can cooperate with the pouring lip 6 to form a narrow or restricted region for allowing the water inside the pitcher body 1 to flow through but preventing the ice cubes (not shown in figures) thereinside from leaving therethrough. The cover 8 further includes an upper portion 8B having a window 10 for refilling water and ice cubes into the pitcher body 1, in which the window 10 is located opposite to the pouring cutout 9.

In addition, a first protrusion 11 and a second protrusion 12 are formed internal to the interior pipe 2 and located close to the upper opening 5 to sandwich in space the pouring lip 6. A third protrusion 13 of the interior pipe 2 located close to the upper opening 5 is formed opposite to the pouring lip 6. On the other hand, a first hole 14 and a second hole 15 are formed external to the perimeter 8A of the cover 8 to sandwich in space the pouring cutout 9, for pairing with the first protrusion 11 and the second protrusion 12 to form a pair of stopper mechanisms, respectively. Also, a lower rim of the perimeter 8A can be used to pair with a top end of the third protrusion 13 for preventing the cover 8 from being collapsed into the pitcher body 1. Preferably, a stopper 16 can be formed to the lower rim of the perimeter 8A for pairing with the third protrusion 13.

As shown in FIG. 1, individual stopper 18 can be formed interior between the pouring lip 6 and the first or second protrusions 11 or 12 for cooperating with a respective cutout edge 17 of the pouring cutout 9.

Purposes of aforesaid elements will be explained in the following description.

While the cover 8 is mounted upon the upper opening 5 of the pitcher body 1, the cutout edges 17 of the pouring cutout 9 are rested against the stoppers, the first protrusion 11 and the second protrusion 12 are mating respectively with the first hole 14 and the second hole 15, and the stopper 16 contact against the third protrusion 13. Under such an arrangement, the cover 8 can be rested safely at a predetermined position of the upper opening 5.

With the cover 8 mounting at the pitcher body 1, the water pitcher of the present invention can receive water and ice cubes from the window 10. While pouring the water, the handle 7 is used to incline the water pitcher for allowing the water inside the pitcher body 1 to flow out through the restricted region formed by the pouring lip 6 and the pouring cutout 9. Also, by the restrict region, the ice cubes can be retained inside the pitcher body 1.

After a usage, if necessary, the cover 8 can be removed from the pitcher body 1 for cleansing the interior pipe 2 of the pitcher body 1 so that the water pitcher can be always kept clean.

The water pitch of the present invention as stated in claim 1 includes the pitcher body 1 for accommodating water and ice cubes and the removable cover 8. The pitcher body 1 has the upper opening 5 for providing the pouring lip 6. The cover 8 resting upon the upper opening 5 has the pouring cutout 9 for pouring water and the window 10 for refilling water and ice cubes. By mounting the cover 8 onto the pitcher body 1, the restricted pouring region can be formed by pairing the pouring lip 6 of the pitcher body 1 with the pouring cutout 9 of the removable cover 8. The restricted pouring region can be used to connect the interior and the exterior of the water pitcher and is used to prevent the ice cubes from leaving the water pitcher while pouring the water. The window 10 for refilling water and ice cubes is located opposite to the pouring cutout 9. The water pitcher of the present invention is characterized in that the cover 8 is removable from the upper opening 5 of the pitcher body 1, and that the interior of the water pitcher can be easier cleansed by removing the cover 8.

According to the invention of claim 2, the first protrusion 11, the second protrusion 12 and the third protrusion 13 of the pitcher body 1 can be provided to pair respectively with the first hole 14, the second hole 15, and the stopper 16 of the cover 8 for holding the cover 8 safely at the predetermined position of the pitcher body 1 without the cover 8 being collapsed into the pitcher body 1.

According to the invention of claim 3, the mounting mechanism formed by the protrusions 11, 12 and 13, the holes 14 and 15, and the stopper 16 enables the firmly mounting of the cover 8 onto the pitcher body 1 and also makes the water pitcher being easily cleansed and kept clean.

According to the invention of claim 4, the interior stoppers 18 for positioning the pouring cutout 9 of the cover 8 can be used to align the pouring cutout 9 with the pouring lip 6, and thus to form the restrict region successfully for pouring the water inside the water pitcher.

The advantages of the present invention are following.

The water pitch of the present invention as stated in claim 1 includes the pitcher body for accommodating water and ice cubes and the removable cover. The pitcher body has the upper opening for providing the pouring lip. The cover resting upon the upper opening has the pouring cutout for pouring water and the window for refilling water and ice cubes. By mating the pitcher body and the cover, the restricted pouring region can be formed by the pouring lip of the pitcher body and the pouring cutout of the removable cover. The restricted pouring region can be used to connect the interior and the exterior of the water pitcher and is used to prevent the ice cubes from leaving the water pitcher while pouring the water. The window for refilling water and ice cubes is located opposite to the pouring cutout. The water pitcher of the present invention is characterized in that the cover is removable from the upper opening of the pitcher body. Also, the interior of the water pitcher can be easier cleansed and kept clean by removing the cover.

According to the invention of claim 2, the interior stopper is provided to the pitcher body as an anchoring means for holding the removable cover.

According to the invention of claim 3, the third protrusion of the pitcher body provides its top end to pair with the respective stopper of the cover, so that any dirt on the protrusion can be easily cleansed.

According to the invention of claim 4, the pitcher body can include interior stoppers for positioning the pouring cutout of the cover.

While the present invention has been particularly shown and described with reference to a preferred embodiment, it will be understood by those skilled in the art that various changes in form and detail may be without departing from the spirit and scope of the present invention.

DESCRIPTION OF REFERENCE NUMERALS

1 pitcher body
2 interior pipe
3 exterior jacket
4 vacuum heat-insulation annular spacing
5 upper opening
6 pouring lip
7 handle
8 cover
8A perimeter
8B upper portion
9 pouring cutout
10 window
11 first protrusion
12 second protrusion
13 third protrusion
14 first hole
15 second hole
16 stopper
17 cutout edge
18 stopper

What is claimed is:

1. A water pitcher for accommodating thereinside water and ice cubes, comprising a pitcher body having an upper opening providing a pouring lip and a cover for being removably mounted upon the upper opening, the cover further including thereof a pouring cutout for pouring the water and a window located opposite to the pouring cutout for refilling the water and the ice cubes, the pouring cutout pairing with the pouring lip to form a restricted region for allowing the water to flow therethrough and preventing the ice cubes from leaving the water pitcher, and the water pitcher being characterized in that the cover is removable from the upper opening of the pitcher body and said pitcher body has an interior surface that further includes a stopper for pairing with an edge of said pouring cutout of said cover.

2. A water pitcher for accommodating water and ice cubes, comprising:

a pitcher body having an interior surface, an upper opening including a pouring lip, a pair of stoppers on said interior surface flanking said lip, a first and second protrusion on said interior surface flanking said stoppers, and a third protrusion on said interior surface opposite said lip; and a cover having a top surface and a side surface, said cover removably mounted upon the upper opening of said pitcher and said cover further including, a pouring cutout in said side surface of said pitcher body said cutout having two side edges resting against said stoppers when said cover is mounted upon said opening of said pitcher, said cutout pairing with the pouring lip forming a restricted region allowing the water to flow therethrough and preventing the ice cubes from leaving the water pitcher, a pair of holes in said side surface of said cover flanking said cutout, said first and second protrusions insertable within said holes;

a lower rim opposite said pouring cutout and resting on said third protrusion when said cover is mounted upon said upper opening of the pitcher; and a window in said upper surface for refilling the water and the ice cubes.

* * * * *

UNITED STATES PATENT AND TRADEMARK OFFICE

CERTIFICATE OF CORRECTION

PATENT NO. : 6,394,322 B1
DATED : May 28, 2002
INVENTOR(S) : Makoto Sekiya et al.

It is certified that error appears in the above-identified patent and that said Letters Patent is hereby corrected as shown below:

Column 3,
Line 29, "According to the invention of claim 3, ..." should read
-- According to the invention, --.
Line 35, "According to the invention of claim 4, ..." should read
-- According to the invention, --.
Line 61, "According to the invention of claim 3, ..." should read
-- According to the invention, --.
Line 65, "According to the invention of claim 4,..." should read
-- According to the invention, --.

Signed and Sealed this

Twentieth Day of May, 2003

JAMES E. ROGAN
*Director of the United States Patent and Trademark Office*